US008585251B2

(12) United States Patent
Scott

(10) Patent No.: US 8,585,251 B2
(45) Date of Patent: Nov. 19, 2013

(54) LIGHT EMITTING DIODE LAMP

(75) Inventor: Keith Scott, Sunnyvale, CA (US)

(73) Assignee: Bridgelux, Inc., Livermore, CA (US)

( * ) Notice: Subject to any disclaimer, the term of this patent is extended or adjusted under 35 U.S.C. 154(b) by 418 days.

(21) Appl. No.: 12/334,282

(22) Filed: Dec. 12, 2008

(65) Prior Publication Data

US 2010/0148651 A1 Jun. 17, 2010

(51) Int. Cl.
*F21V 3/00* (2006.01)
*F21V 5/00* (2006.01)

(52) U.S. Cl.
USPC ..... 362/311.02; 362/249.02; 362/294; 362/373; 362/800

(58) Field of Classification Search
USPC ..... 362/249.02, 311.02, 373, 545, 800, 294
See application file for complete search history.

(56) References Cited

U.S. PATENT DOCUMENTS

| | | | | |
|---|---|---|---|---|
| 6,220,722 | B1 | 4/2001 | Begemann | |
| 6,634,770 | B2 | 10/2003 | Cao | |
| 6,815,724 | B2 | 11/2004 | Dry | |
| 6,853,151 | B2 | 2/2005 | Leong et al. | |
| 6,864,513 | B2 * | 3/2005 | Lin et al. | 257/99 |
| 7,204,615 | B2 | 4/2007 | Arik et al. | |
| 7,534,002 | B2 | 5/2009 | Yamaguchi et al. | |
| 2005/0243552 | A1 | 11/2005 | Maxik | |
| 2005/0276053 | A1 | 12/2005 | Nortrup et al. | |
| 2006/0126338 | A1 | 6/2006 | Mighetto | |
| 2008/0298059 | A1 | 12/2008 | Schug et al. | |
| 2012/0319581 | A1 | 12/2012 | Betsuda et al. | |

FOREIGN PATENT DOCUMENTS

| | | |
|---|---|---|
| CN | 2593227 Y | 12/2003 |
| JP | 3099741 | 11/2003 |
| JP | 2008198478 | 8/2008 |
| WO | 0017569 | 3/2000 |
| WO | WO 2006/-079111 A2 | 7/2006 |
| WO | 2009040703 A3 | 4/2009 |

OTHER PUBLICATIONS

Office Action for Korean application No. 2011-7016188 mailed by the Korean Intellectual Property Office on Nov. 21, 2012.
Office Action and Search Report for Chinese application No. 200980155969.3 mailed by the State Intellectual Property Office on Nov. 19, 2012.
Japanese Office Action for Application No. 2011-540738 dated Mar. 26, 2013 (15 pages).
International Search Report for PCT/US2009/062626 dated Dec. 29, 2009, 10 pages.
International Preliminary Report for PCT/US2009/062626 dated Jan. 21, 2009, 13 pages.

* cited by examiner

*Primary Examiner* — Jason Moon Han
(74) *Attorney, Agent, or Firm* — Arent Fox LLP

(57) ABSTRACT

A light emitting apparatus includes a housing having a transparent portion, at least one LED positioned within the housing to emit light through the transparent portion, and a fan positioned within the housing to cool said at least one LED.

19 Claims, 7 Drawing Sheets

LIGHT EMITTING DIODE LAMP

BACKGROUND

1. Field

The present disclosure relates to light emitting devices, and more particularly to light emitting diode lamps.

2. Background

Light emitting diodes (LEDs) are attractive candidates for replacing conventional light sources such as incandescent and fluorescent lamps. LEDs have substantially higher light conversion efficiencies than incandescent lamps and longer lifetimes than both types of conventional light sources. In addition, some types of LEDs now have higher conversion efficiencies than fluorescent light sources and still higher conversion efficiencies have been demonstrated in the laboratory. Finally, LEDs require lower voltages than fluorescent lamps, and therefore, provide various power saving benefits.

Despite the advantages of using LEDs as light sources, consumer acceptance will depend largely on the adaptability of these sources into existing lighting fixtures using conventional light sources (e.g., incandescent or fluorescent lamps). LED light sources designed for direct replacement of conventional light sources could be instrumental in accelerating consumer acceptance, and thereby, revolutionize the lighting industry. Unfortunately, there exists significant challenges in designing LED light sources that directly replace existing light sources, such as the incandescent light bulb for example.

SUMMARY

In one aspect of the disclosure, a light emitting apparatus includes a housing having a transparent portion, at least one LED positioned within the housing to emit light through the transparent portion, and a fan positioned within the housing to cool said at least one LED.

In another aspect of the disclosure, a light emitting apparatus includes at least one LED configured to emit light, a housing having means for transmitting the light emitted by said at least one LED, and means, positioned within the housing, for cooling said at least one LED.

In a further aspect of the disclosure, light emitting apparatus includes at least one LED configured to emit light, a housing containing said at least one LED, wherein the housing comprises a transparent portion positioned to transmit the light emitted from said at least one LED, and a fan positioned within the housing to cool said at least one LED.

It is understood that other aspects of the present invention will become readily apparent to those skilled in the art from the following detailed description, wherein it is shown and described only exemplary configurations of an LED lamp by way of illustration. As will be realized, the present invention includes other and different aspects of an LED lamp and its several details are capable of modification in various other respects, all without departing from the spirit and scope of the present invention. Accordingly, the drawings and the detailed description are to be regarded as illustrative in nature and not as restrictive.

BRIEF DESCRIPTION OF THE FIGURES

Various aspects of the present invention are illustrated by way of example, and not by way of limitation, in the accompanying drawings, wherein.

DETAILED DESCRIPTION

Figure 1:
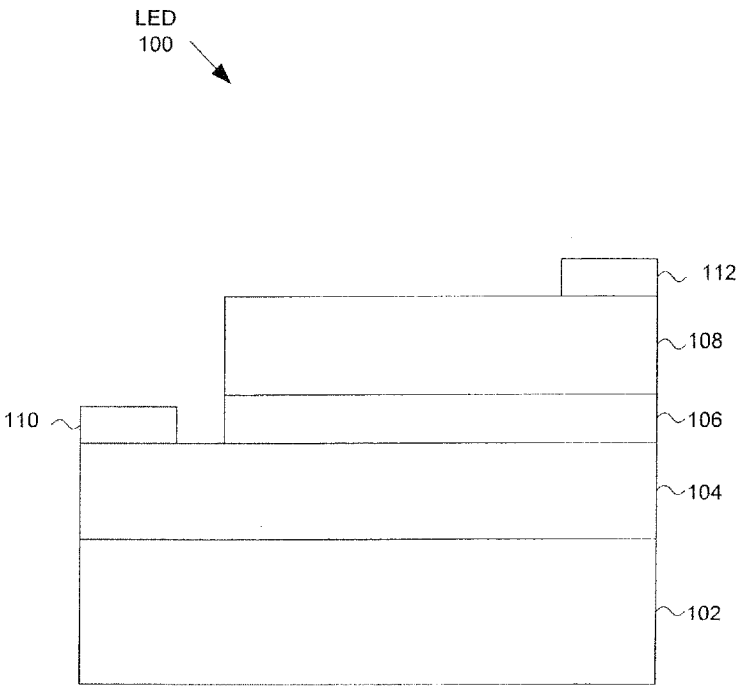
FIG. 1 is a conceptual cross-sectional view illustrating an example of an LED.

The present invention is described more fully hereinafter with reference to the accompanying drawings, in which various aspects of the present invention are shown. This invention, however, may be embodied in many different forms and should not be construed as limited to the various aspects of the present invention presented throughout this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items Various aspects of an LED lamp will now be presented. However, as those skilled in the art will readily appreciate, these aspects may be extended to other light sources without departing from the invention. The LED lamp may be configured as a direct replacement for conventional light sources, including, by way of example, incandescent, fluorescent, halogen, quartz, high-density discharge (HID), and neon lamps or bulbs. In these configurations, one or more LEDs may be mounted with a fan in a housing. The housing may have a transparent portion for transmitting light emitted by the LEDs. The LED is well known in the art, and therefore, will only briefly be discussed to provide a complete description of the invention.

FIG. 1 is a conceptual cross-sectional view illustrating an example of an LED. An LED is a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, and is referred respectively as n-type or p-type semiconductor regions. Referring to FIG. 1, the LED 100 includes an n-type semiconductor region 104 and a p-type semiconductor region 108. A reverse electric field is created at the junction between the two regions, which cause the electrons and holes to move away from the junction to form an active region 106. When a forward voltage sufficient to overcome the reverse electric field is applied across the p-n junction through a pair of electrodes 110, 112, electrons and holes are forced into the active region 106 and recombine. When electrons recombine with holes, they fall to lower energy levels and release energy in the form of light.

In this example, the n-type semiconductor region 104 is formed on a substrate 102 and the p-type semiconductor region 108 is formed on the active layer 106, however, the regions may be reversed. That is, the p-type semiconductor region 108 may be formed on the substrate 102 and the n-type semiconductor region 104 may formed on the active layer 106. As those skilled in the art will readily appreciate, the various concepts described throughout this disclosure may be extended to any suitable layered structure. Additional layers or regions (not shown) may also be included in the LED 100, including but not limited to buffer, nucleation, contact and current spreading layers or regions, as well as light extraction layers.

The p-type semiconductor region 108 is exposed at the top surface, and therefore, the p-type electrode 112 may be readily formed thereon. However, the n-type semiconductor region 104 is buried beneath the p-type semiconductor layer 108 and the active layer 106. Accordingly, to form the n-type electrode 110 on the n-type semiconductor region 104, a cutout area or "mesa" is formed by removing a portion of the active layer 106 and the p-type semiconductor region 108 by means well known in the art to expose the n-type semiconductor layer 104 therebeneath. After this portion is removed, the n-type electrode 110 may be formed.

Figure 2:
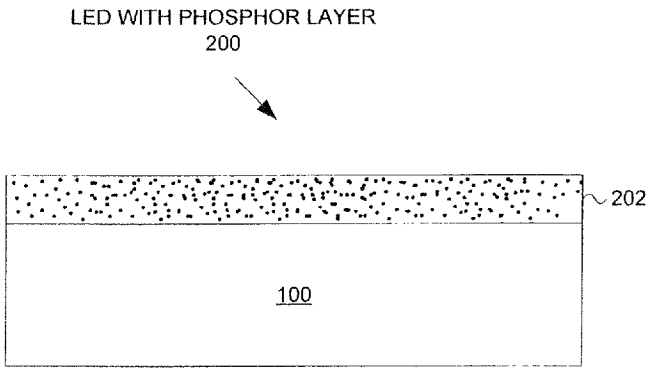
FIG. 2 is a conceptual cross-sectional view illustrating an example of an LED with a phosphor layer.

FIG. 2 is a conceptual cross-sectional view illustrating an example of a LED with a phosphor layer. In this example, a phosphor layer 202 is formed on the top surface of the LED 100 by means well known in the art. The phosphor layer 202 converts a portion of the light emitted by the LED 100 to light having a different spectrum from that emitted from the LED 100. A white LED light source can be constructed by using an LED that emits light in the blue region of the spectrum and a phosphor that converts blue light to yellow light. A white light source is well suited as a replacement lamp for conventional light sources, however, the invention may be practiced with other LED and phosphor combinations to produce different color lights. The phosphor layer 202 may include, by way of example, phosphor particles suspended in a carrier or be constructed from a soluble phosphor that is dissolved in the carrier.

Figure 3A:
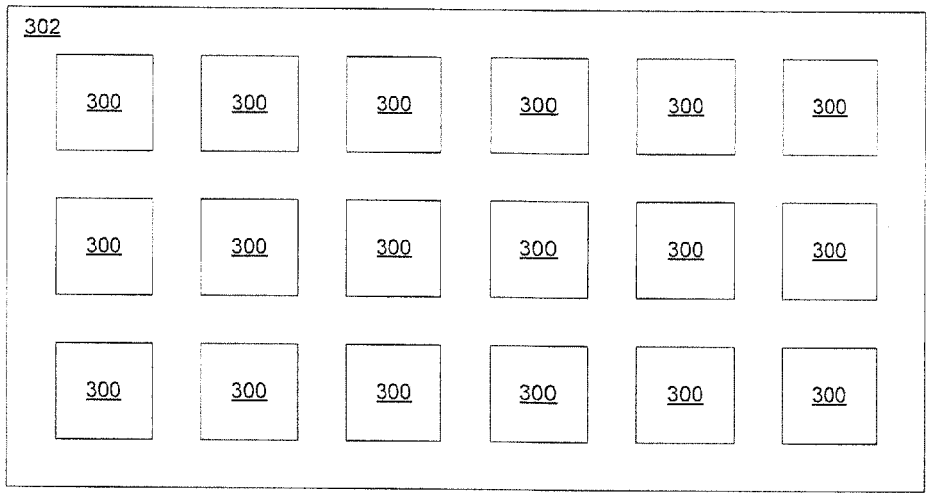
FIG. 3A is a conceptual top view illustrating an example of an LED array.
Figure 3B:
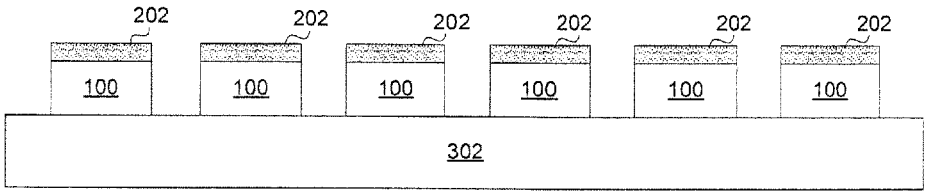
FIG. 3B is a conceptual cross-sectional view of the LED array of FIG. 3A.

In a configuration of an LED lamp, an LED array may be used to provide increased luminance. FIG. 3A is a conceptual top view illustrating an example of an LED array, and FIG. 3B is a conceptual cross-sectional view of the LED array of FIG. 3A. In this example, a number of phosphor-coated LEDs 300 may be formed on a substrate 302 by means well known in the art. The bond wires (not shown) extending from the LEDs 300 may be connected to traces (not shown) on the surface of the substrate 302, which connect the LEDs 300 in a parallel and/or series fashion. Typically, the LEDs 300 may be connected in parallel streams of series LEDs with a current limiting resistor (not shown) in each stream. The substrate 302 may be any suitable material that can provide support to the LEDs 300 and can be mounted within a housing (not shown).

Figure 4A:
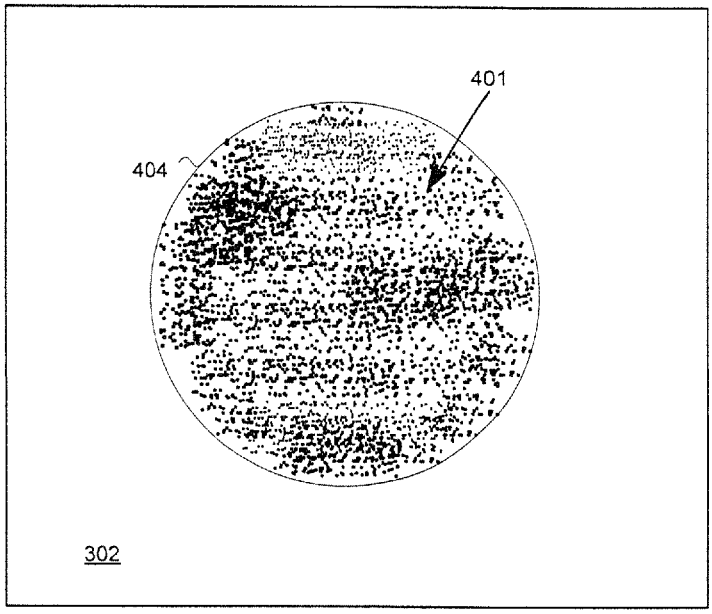
FIG. 4A is a conceptual top view illustrating an example of an alternative configuration of an LED array.
Figure 4B:
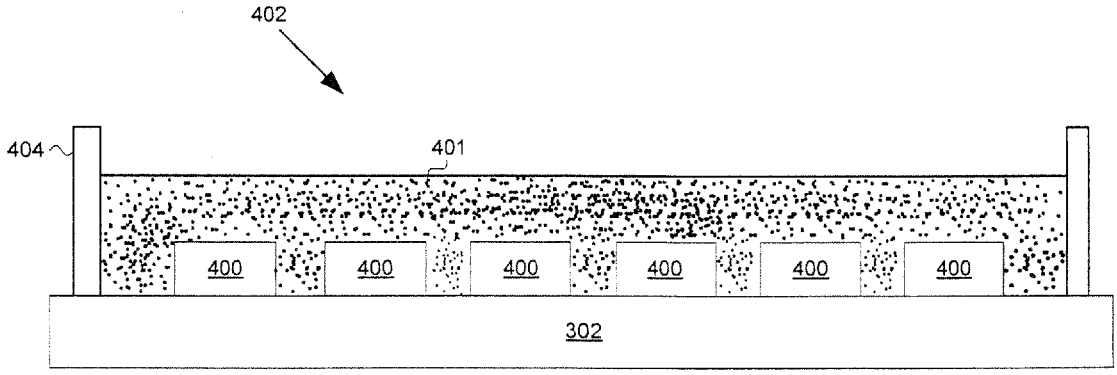
FIG. 4B is a conceptual cross-sectional view of the LED array of FIG. 4A.

FIG. 4A is a conceptual top view illustrating an example of an alternative configuration of an LED array, and FIG. 4B is a conceptual cross-sectional view of the LED array of FIG. 4A. In a manner similar to that described in connection with FIGS. 3A and 31, a substrate 302 designed for mounting in a housing (not shown) may be used to support an array of LEDs 400. However, in this configuration, a phosphor layer is not formed on each individual LED. Instead, phosphor 401 is deposited within a cavity 402 bounded by an annular ring 404 that extends circumferentially around the outer surface of the substrate 302. The annular ring 404 may be formed by boring a cylindrical hole in a material that forms the substrate 302. Alternatively, the substrate 302 and the annular ring 404 may be formed with a suitable mold, or the annular ring 404 may be formed separately from the substrate 302 and attached to the substrate using an adhesive or other suitable means. In the latter configuration, the annular ring 404 is generally attached to the substrate 302 before the LEDs 400, however, in some configurations, the LEDs 400 may be attached first. Once the LEDs 400 and the annular ring 404 are attached to the substrate 302, a suspension of phosphor particles in a carrier may be introduced into the cavity 402. The carrier material may be an epoxy or silicone, however, carriers based on other materials may also be used. The carrier material may be cured to produce a solid material in which the phosphor particles are immobilized.

Figure 5:
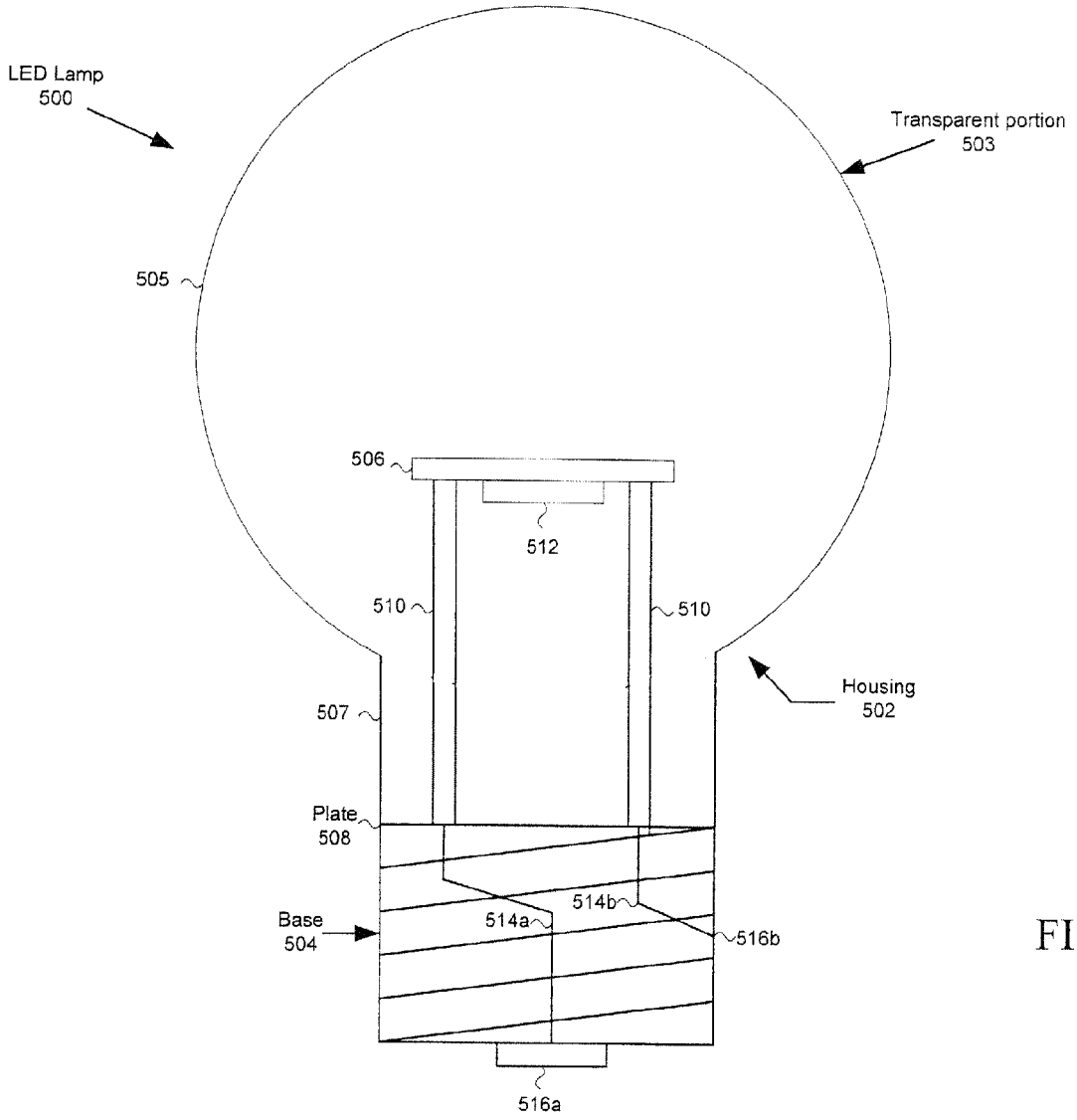
FIG. 5 is a conceptual side view of an LED lamp.

FIG. 5 is a conceptual side view of an LED lamp. The LED lamp 500 may include a housing 502 having a transparent portion 503 (e.g., glass, plastic, etc.) mounted onto a base 504. The transparent portion 503 is shown with a substantially circular or elliptical portion 505 extending from a neck portion 507, although the transparent portion 503 may take on other shapes and forms depending on the particular application.

An LED array 506 positioned within the housing 502 may be used as a light source. The LED array 506 may take on various forms, including any one of the configurations discussed earlier in connection with FIGS. 2-4, or any other suitable configuration now known or developed in the future. Although an LED array is well suited for the LED lamp, those skilled in the art will readily understand that the various concepts presented throughout this disclosure are not necessarily limited to array and may be extended to an LED lamp with a single LED.

A plate 508 anchored to the base 504 provides support for the LED array 506. In one configuration of an LED lamp 500, standoffs 510 extending from the plate 508 are used to separate the LED array 506 from the plate 508. Examples include plastic standoffs with conical heads that can be pushed through holes in the substrate of the LED array 506 or hollow plastic standoffs with internal threads that allow the LED array to be mounted with screws. Other ways to mount the LED array 506 will be readily apparent to those skilled in the art from the teachings presented throughout this disclosure. The plate 508 may be constructed from any suitable insulting material, including by way of example, glass.

A fan 512 may be used to cool the LED array 504. A non-limiting example of a fan that is well suited for LED lamp applications is a RSD5 solid-state fan developed by Thorrn Micro Technologies, Inc. The RSD5 uses a series of live wires that produce an ion rich gas with free electrons for conducting electricity. The wires lie within uncharged conducting plates that are contoured into half-cylindrical shape to partially envelope the wires. Within the electric field that results, the ions push neutral air molecules from the wire to the plate, generating air flow. The fan 512 may be mounted to the substrate of the LED array 504 as shown in FIG. 5, but may be mounted elsewhere in the housing 502. Those skilled in the art will be readily able to determine the location of the fan best suited for any particular application based on the overall design parameters.

The plate 508 also provides a means for routing wires 514*a* and 514*b* from the LED array 504 to electrical contacts 516*a* and 516*b* on the base 510. In one configuration of an LED lamp 500, the wires 514*a* and 514*b* may be routed from the LED array 504 to the plate 512 through the plastic hollow standoffs previously described. In another configuration of an LED lamp 500, the wires 514*a* and 514*b* themselves can be used to separate the LED array 504 from the plate 508, thus eliminating the need for standoffs. In the latter configuration, the wires 514*a* and 514*b* may be spot welded to feedthrough holes in the plate 508 with another set of spot welded wires extending from the feedthrough holes to the electrical contacts 516*a* and 516*b* on the base 510.

The arrangement of electrical contacts 516*a* and 516*b* may vary depending on the particular application. By way of example, the LED lamp 500 may have a base 510 with a screw cap, as shown in FIG. 5, with one electrical contact 516*a* at the tip of the base 510 and the screw cap serving as the other electrical contact 516*b*. Contacts in the lamp socket (not shown) allow electrical current to pass through the base 510 to the LED array 504. Alternatively, the base may have a bayonet cap with the cap used as an electrical contact or only as a mechanical support. Some miniature lamps may have a wedge base and wire contacts, and some automotive and special purpose lamps may include screw terminals for connection to wires. The arrangement of electrical contacts for any particular application will depend on the design parameters of that application.

Power may be applied to the LED array 506 and the fan 512 through the electrical contacts 516*a* and 516*b*. An AC-DC converter (not shown) may be used to generate a DC voltage from a lamp socket connected to a wall-plug in a household, office building, or other facility. The DC voltage generated by the AC-DC converter may be provided to a driver circuit (not shown) configured to drive both the LED array 506 and the fan 512. The AC-DC converter and the driver circuit may be located in the base 504, on the LED array 506, or anywhere else in the housing 502. In some applications, the AC-DC converter may not be needed. By way of example, the LED array 506 and the fan 512 may be designed for AC power. Alternatively, the power source may be DC, such as the case might be in automotive applications. The particular design of the power delivery circuit for any particular application is well within the capabilities of one skilled in the art.

Figure 6:
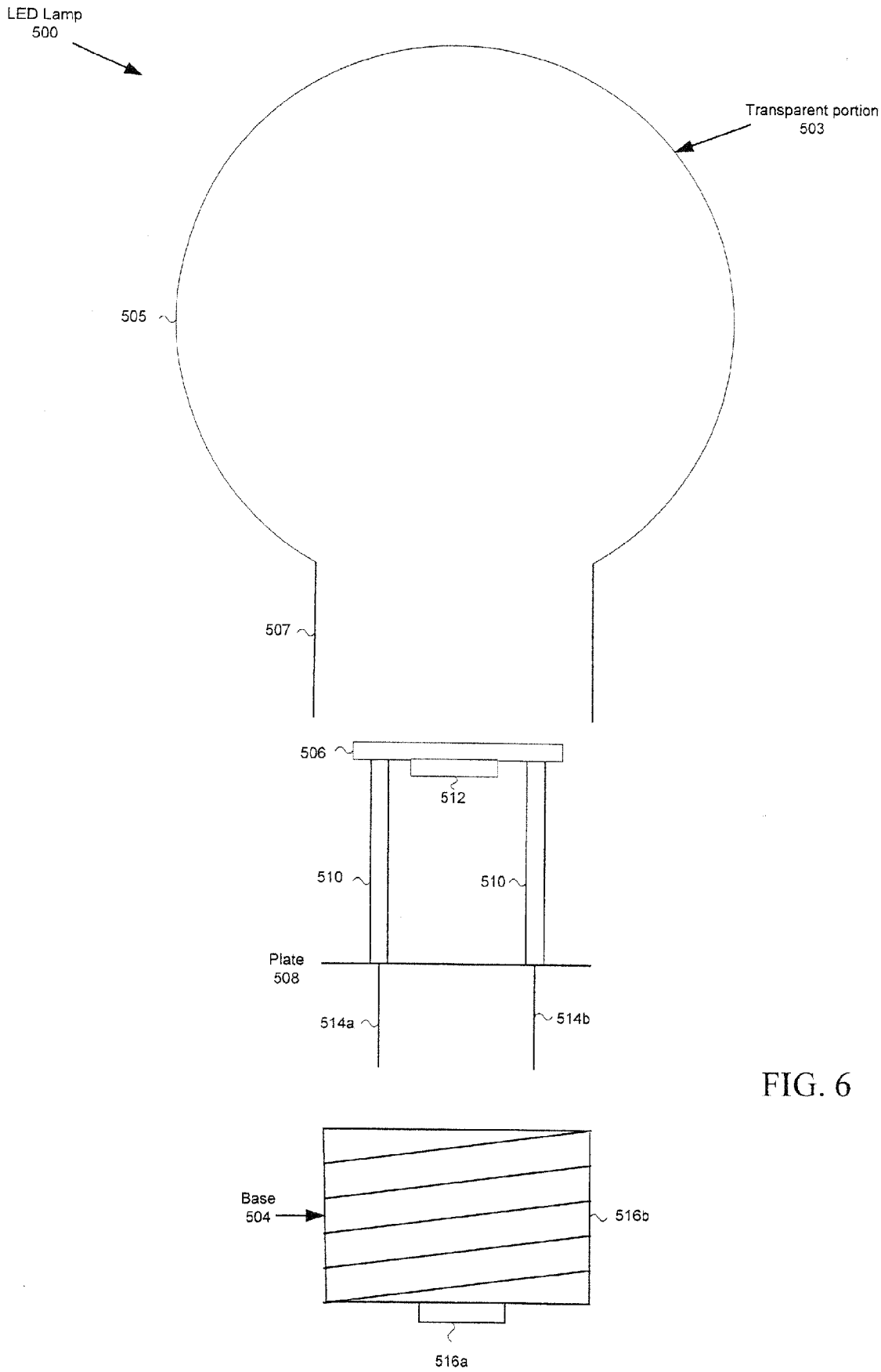
FIG. 6 is a exploded side view of the LED lamp of FIG. 5.

An example of a process for manufacturing an LED lamp 500 will now be presented with reference to FIG. 6. FIG. 6 is an exploded side view of the LED lamp 500 showing the individual dissembled elements of the LED lamp 500 in their proper relationship with respect to their assembled position. In this example, the disassembled elements include the transparent portion 503 of the housing, the plate 508, and the base 504.

The LED lamp 500 may be assembled by mounting the LED array 506 and the fan 512 onto the plate 508 using standoffs 510 or some other suitable means. Once the LED array 506 and the fan 512 are mounted to the plate 508, the plate may be attached to the neck 507 of the transparent portion 503 of the housing. The transparent portion 503 of the housing may be formed from plastic or glass (which is manufactured by feeding silica into a furnace) and shaped by placing the it in a mold to cure. In the case where the plate 508 is glass, the transparent portion 503 may be fused to the plate. The electrical wires 514*a* and 514*b* extending from the plate 508 may be connected to the electrical contacts 516*a* and 516*b*, respectively, and then transparent portion 503 of the housing may be mounted to the base 504.

Figure 7:
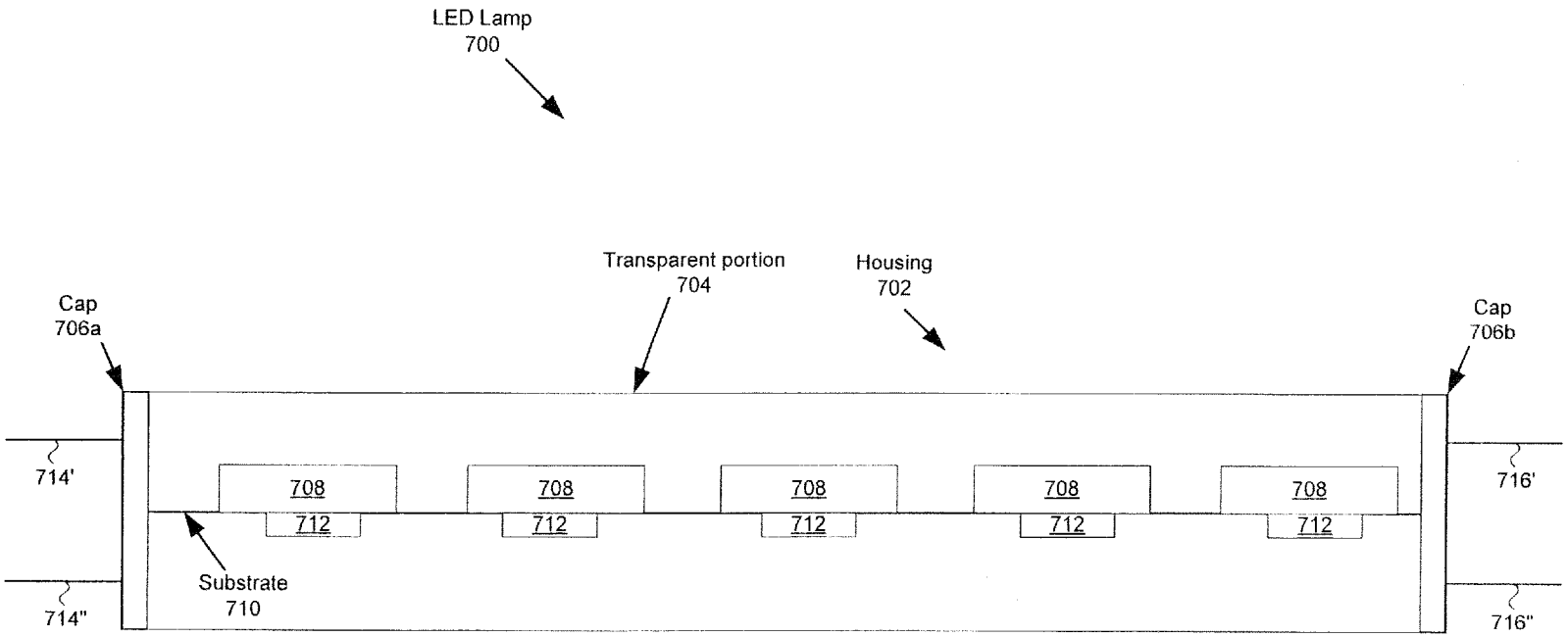
FIG. 7 is a conceptual side view of another configuration of an LED lamp.

FIG. 7 is a conceptual side view of another configuration of an LED lamp. In this configuration, a housing 702 includes a transparent portion 704 in the shape of a tube with caps 706*a* and 706*b* at the ends. A number of LED arrays 708 may be distributed along a substrate 710 that extends across the tubular transparent portion 704 of the housing 702. Alternatively, the substrate 710 may support a single LED array, or even a single LED. The various configurations of LEDs and LED arrays presented thus far are well suited for this LED lamp application, but other configurations may also be used. A number of RSD5 fans 712, or other cooling devices, may also be distributed along the substrate, or located elsewhere, to cool the LED arrays 708. Two electrical contacts 714' and 714" extend from one cap 706*a* and two electrical contacts 716' and 716" extend from the other cap 706*b*. The electrical contact arrangement allows the LED lamp to function as a direct replacement for conventional fluorescent lamps.

Power may be applied between to the LED arrays 708 and the fans 712 through any pair of electrical contacts. By way of example, one of the electrical contacts 714' on one cap 706*a* may be connected to a voltage source and one of the electrical contacts 716' on the other cap 706*b* may be connected to the voltage return. In higher current applications, the voltage source may be connected to both electrical contacts 714' and 714" extending from one cap 706*a* and the voltage return may be connected to both electrical contacts 716' and 716" extending from the other cap 706*b*. An AC-DC converter (not shown) and driver (not shown) may be used to generate a DC voltage and drive the LED arrays 708 and fans 712. The AC-DC converter and driver may be mounted onto the substrate 610 or located elsewhere in the LED lamp 700. Alternatively, the AC-DC converter and/or driver may be mounted outside the lamp, either inside or outside of the light fixture.

The various aspects of this disclosure are provided to enable one of ordinary skill in the art to practice the present invention. Various modifications to aspects presented throughout this disclosure will be readily apparent to those skilled in the art, and the concepts disclosed herein may be extended to other LED lamp configurations regardless of the shape or diameter of the glass enclosure and the base and the arrangement of electrical contacts on the lamp. By way of example, these concepts may be applied to bulb shapes commonly referred to in the art as A series, B series, C-7/F series, ER, G series, GT, K, P-25/PS-35 series, BR series, MR series, AR series, R series, RP-11/S series, PAR Series, Linear series, and T series; ED17, ET, ET-18, ET23.5, E-25, BT-28, BT-37, BT-56. These concepts may also be applied to base sizes commonly referred to in the art as miniature candela screw base E10 and E11, candela screw base E12, intermediate candela screw base E17, medium screw base E26, E26D, E27 and E27D, mogul screw base E39, mogul Pf P40s, medium skirt E26/50×39, candela DC bay, candela SC bay B15, BA15D, BA15S, D.C. Bayonet, 2-lug sleeve B22d, 3-lug sleeve B22-3, medium Pf P28s, mogul bi-post G38, base RSC, screw terminal, disc base, single contact, medium bi-post, mogul end prong, spade connector, mogul pre-focus and external mogul end prong; admedium skirted, medium skirted, position-oriented mogul, BY 22 D, Fc2, ceramic spade series (J, G, R), RRSC, RSC; single pin series, bi-pin series, G, GX, 2G series. Thus, the claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A light emitting apparatus, comprising:

a housing having an electrical base and a transparent portion coupled thereto;

at least one LED positioned within the housing on one or more hollow standoffs mounted on a plate coupled to the base to emit light through the transparent portion; and a fan positioned within the housing under said at least one LED in a space between said LED and said plate and mounted directly to the at least one LED with no intermediate air gap to cool said at least one LED.

2. The light emitting apparatus of claim 1 wherein said at least one LED comprises an array of LEDs.

3. The light emitting apparatus of claim 1 further comprising phosphor within the housing, wherein each of said one LED is arranged to emit light through the phosphor.

4. The light emitting apparatus of claim 1 wherein the base is configured to electrically and mechanically mate with a lamp socket.

5. The light emitting apparatus of claim 4 wherein the base comprises a screw cap configured to mechanically mate with the lamp socket.

6. The light emitting apparatus of claim 1, wherein the plate is positioned between the base and the transparent portion of the housing, wherein said at least one LED is supported by the plate via the standoffs.

7. The light emitting apparatus of claim 6 wherein the base comprises electrical contacts, and wherein the plate provides a feedthrough for coupling the electrical contacts to said at least one LED.

8. The light emitting apparatus of claim of claim 7 wherein said at least one LED includes wires for coupling to the electrical contacts, each of at least one of the wires being routed through one of the standoffs.

9. The light emitting apparatus of claim 7 wherein said at least one LED includes wires for coupling to the electrical contacts, and wherein said at least one LED is supported by the plate by at least one of the wires.

10. A light emitting apparatus, comprising:

at least one LED configured to emit light;

a housing having an electrical base and means for transmitting the light emitted by said at least one LED, said at least one LED disposed on one or more hollow standoffs mounted on a plate coupled to the base, the LED comprising a substrate on which the at least one LED is disposed, wherein the substrate is mounted to the plate via the standoffs to create a space between the substrate and the plate; and means for cooling said at least one LED by forced convection, positioned within the housing and mounted under said at least one LED and said substrate in the space and mounted directly to the substrate with no intermediate air gap.

11. The light emitting apparatus of claim 10 wherein said at least one LED comprises an array of LEDs.

12. The light emitting apparatus of claim 10 wherein said at least one LED emits the light at a first wavelength, the light emitting apparatus further comprising means for converting the light emitted by said at least one LED to a second wavelength.

13. The light emitting apparatus of claim 10 wherein the base further comprises means for electrically and mechanically mating with a lamp socket.

14. The light emitting apparatus of claim 10 further comprising means for supporting said at least one LED.

15. A light emitting apparatus, comprising:

at least one LED configured to emit light;

a housing containing said at least one LED, wherein the housing comprises an electrical base and a transparent portion positioned to transmit the light emitted from said at least one LED, said at least one LED disposed on one or more hollow standoffs mounted on a plate coupled to the base, the LED comprising a substrate on which the at least one LED is disposed, wherein the substrate is mounted to the plate via the standoffs to create a space between the substrate and the plate; and a fan positioned within the housing and mounted under said at least one LED and said substrate in the space and mounted directly to said substrate on which said at least one LED is disposed to cool said at least one LED.

16. The light emitting apparatus of claim 15 wherein said at least one LED comprises an array of LEDs.

17. The light emitting apparatus of claim 15 further comprising phosphor within the housing, wherein each of said one LED is arranged to emit light through the phosphor.

18. The light emitting apparatus of claim 15 wherein the base is configured to electrically and mechanically mate with a lamp socket.

19. The light emitting apparatus of claim 15, wherein the plate is positioned between the base and the transparent portion of the housing, wherein said at least one LED is supported by the plate.

* * * * *